US010569550B2

(12) United States Patent
Tanaka et al.

(10) Patent No.: US 10,569,550 B2
(45) Date of Patent: Feb. 25, 2020

(54) INKJET RECORDING APPARATUS

(71) Applicant: CANON KABUSHIKI KAISHA, Tokyo (JP)

(72) Inventors: Yusuke Tanaka, Kawasaki (JP); Tetsu Hamano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/036,598

(22) Filed: Jul. 16, 2018

(65) Prior Publication Data

US 2019/0030895 A1 Jan. 31, 2019

(30) Foreign Application Priority Data

Jul. 28, 2017 (JP) ..... 2017-146728

(51) Int. Cl.
*B41J 2/165* (2006.01)

(52) U.S. Cl.
CPC ..... *B41J 2/16505* (2013.01); *B41J 2/16508* (2013.01); *B41J 2/16511* (2013.01); *B41J 2/16517* (2013.01); *B41J 2/16523* (2013.01); *B41J 2/16538* (2013.01)

(58) Field of Classification Search
CPC . B41J 2/16505; B41J 2/16511; B41J 2/16547
USPC ..... 347/29, 32
See application file for complete search history.

(56) References Cited

U.S. PATENT DOCUMENTS 6,629,749 B2 * 10/2003 Miyauchi ..... B41J 2/16511 347/29
10,214,016 B2 * 2/2019 Shimada ..... B41J 2/185

FOREIGN PATENT DOCUMENTS

JP 2015-3435 A 1/2015

* cited by examiner

*Primary Examiner* — An H Do
(74) *Attorney, Agent, or Firm* — Canon U.S.A., Inc. IP Division

(57) ABSTRACT

An inkjet recording apparatus includes a recording head including a discharge opening surface in which a discharge opening is arranged, a cap unit capable of being moved to a capping position to cover the discharge opening surface and to a retracted position not to cover the discharge opening surface, a cam mechanism configured to move the cap unit, and moving member configured to conduct a separation operation to move the cap unit from the capping position to the retracted position. The cam mechanism includes a first cam portion capable of being brought into contact with the moving member and a second cam portion capable of being brought into contact with the cap unit, and the separation operation is conducted by bringing the first cam portion and the moving member into contact with each other.

12 Claims, 8 Drawing Sheets

CAPPING POSITION

RETRACTED POSITION

ROTATION DIRECTION B
ROTATION DIRECTION A

CAPPING POSITION
(1) CASE IN WHICH SEPARATION OPERATION IS EASY
(2) CASE IN WHICH SEPARATION OPERATION IS DIFFICULT
2
31
48
44
45
47
46c
45a
46b
46a
33

DURING CAP SEPARATION
2
23
31
44
33b
45
46b
33c
45a

DURING CAP SEPARATION
2
31
44
45
33b
46b
33c
F
45a

RETRACTED POSITION
31
2
44
23
47
46b
45
33b
33c
45a
11

ROTATION DIRECTION B
ROTATION DIRECTION A

CAPPING POSITION
(1) CASE IN WHICH SEPARATION OPERATION IS EASY
(2) CASE IN WHICH SEPARATION OPERATION IS DIFFICULT
2
85
84
31
45
83
45a
46a
46c
46

DURING CAP SEPARATION
85a
84b
85b
84a
83c
83
83b

DURING CAP SEPARATION
F

RETRACTED POSITION
23
11

INKJET RECORDING APPARATUS

BACKGROUND OF THE INVENTION

Field of the Invention

The disclosure relates to an inkjet recording apparatus including a cap of a recording head.

Description of the Related Art

Japanese Patent Application Laid-Open No. 2015-3435 discusses a recording apparatus including a cap which covers a discharge opening surface to protect a recording head and prevent the recording head from drying. The contact pressure of the cap with respect to the discharge opening surface is selectable from a plurality of levels based on the use status to thereby reduce discharge failures of the recording head. A cam mechanism is provided to elevate/lower the cap and also to adjust the contact pressure.

However, if the cap including an elastic member such as a rubber in the structure discussed in Japanese Patent Application Laid-Open No. 2015-3435 is abutted hard against the discharge opening surface, the cap can adhere to the discharge opening surface to hinder the cam mechanism from smoothly elevating/lowering the cap.

SUMMARY OF THE INVENTION

The disclosure is directed to an inkjet recording apparatus capable of separating a cap from a discharge opening surface with ease.

According to an aspect of the disclosure, an inkjet recording apparatus includes a recording head including a discharge opening surface in which a discharge opening configured to discharge an ink is arranged, a cap unit capable of being moved to a capping position to cover the discharge opening surface and to a retracted position not to cover the discharge opening surface, a cam mechanism configured to move the cap unit, and an moving member configured to conduct a separation operation to move the cap unit from the capping position to the retracted position, wherein the cam mechanism includes a first cam portion capable of being brought into contact with the moving member and a second cam portion capable of being brought into contact with the cap unit, and the separation operation is conducted by bringing the first cam portion and the moving member into contact with each other.

Further features and aspects of the disclosure will become apparent from the following description of numerous example embodiments with reference to the attached drawings.

DESCRIPTION OF THE EMBODIMENTS

A recording apparatus according to various example embodiments of the disclosure will be described below. It should be noted that components described in the example embodiments are mere examples and are not intended to limit the scope of the invention. In the present specification, the term "ink" is used as a generic term for a liquid such as a recording liquid. Further, as used herein, the term "recording" refers to not only the recording on a two-dimensional object but also the recording on a three-dimensional object. As used herein, the term "recording medium" refers to a medium onto which a liquid is to be discharged, and the term "recording medium" is used as a generic term for recording media such as a sheet, cloth, a plastic film, a metal plate, glass, ceramic, wood, and leather. Further, the term "recording medium" refers to not only a cut sheet but also a roll-shaped continuous sheet.

Figure 1:
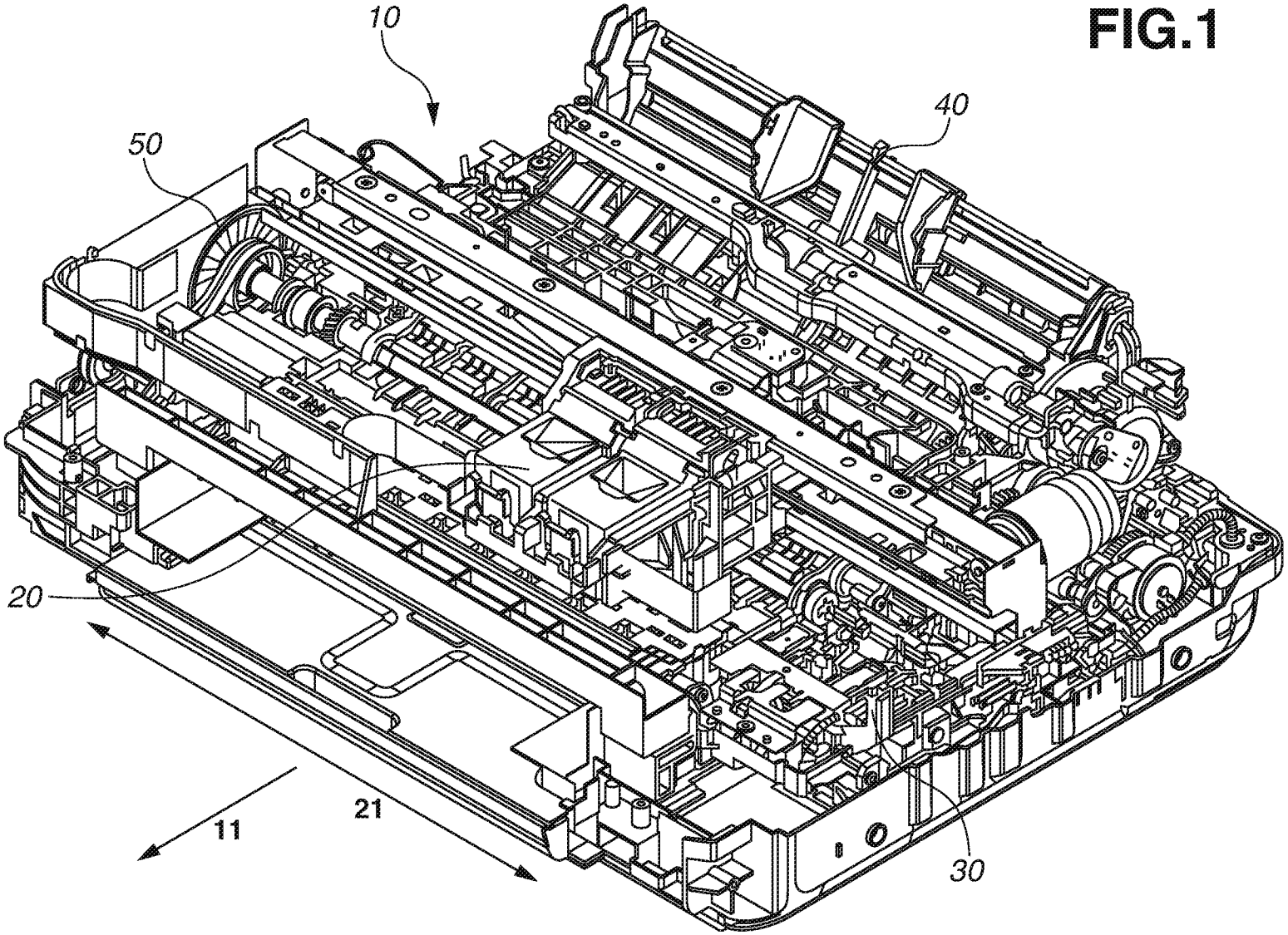
FIG. 1 is a perspective view schematically illustrating an inkjet recording apparatus according to a first example embodiment.

A first example embodiment will be described below. FIG. 1 is a perspective view schematically illustrating an inkjet recording apparatus (hereinafter, "recording apparatus") 10 according to the present example embodiment. The recording apparatus 10 mainly includes a recording head 2 (refer to FIGS. 5A and 5B), a carriage 20, a maintenance unit 30, a sheet feeding unit 40, and a sheet conveyance unit 50. The sheet feeding unit 40 feeds recording media one by one into the main body of the recording apparatus 10. The sheet conveyance unit 50 is disposed downstream of the sheet feeding unit 40 in a sheet conveyance direction 11 specified in FIG. 1 and conveys recording media fed by the sheet feeding unit 40.

The carriage 20 includes the recording head 2 mounted thereon and reciprocates in a main-scan direction 21 intersecting with the sheet conveyance direction 11. In the present example embodiment, the sheet conveyance direction 11 and the main-scan direction 21 are orthogonal to each other. The recording head 2 is attached to the bottom portion of the carriage 20 and records images on recording media conveyed by the sheet conveyance unit 50. The recording head 2 includes a discharge opening surface 23 (refer to FIGS. 5A and 5B) having a plurality of discharge openings from which inks are discharged, and the recording head 2 discharges ink droplets while reciprocating together with the carriage 20 in the main-scan direction 21 to perform a recording operation so that an image of one band is recorded on a recording medium. After an image of one band is recorded on a recording medium, the recording medium is conveyed by the sheet conveyance unit 50 by a predetermined amount in the sheet conveyance direction 11 (intermittent sheet conveyance operation). The operation of recording of one band and the intermittent sheet conveyance operation are repeated to record an image across the recording medium. The recording head 2 can be structured to be removable and attachable from and to the carriage 20.

Figure 3:
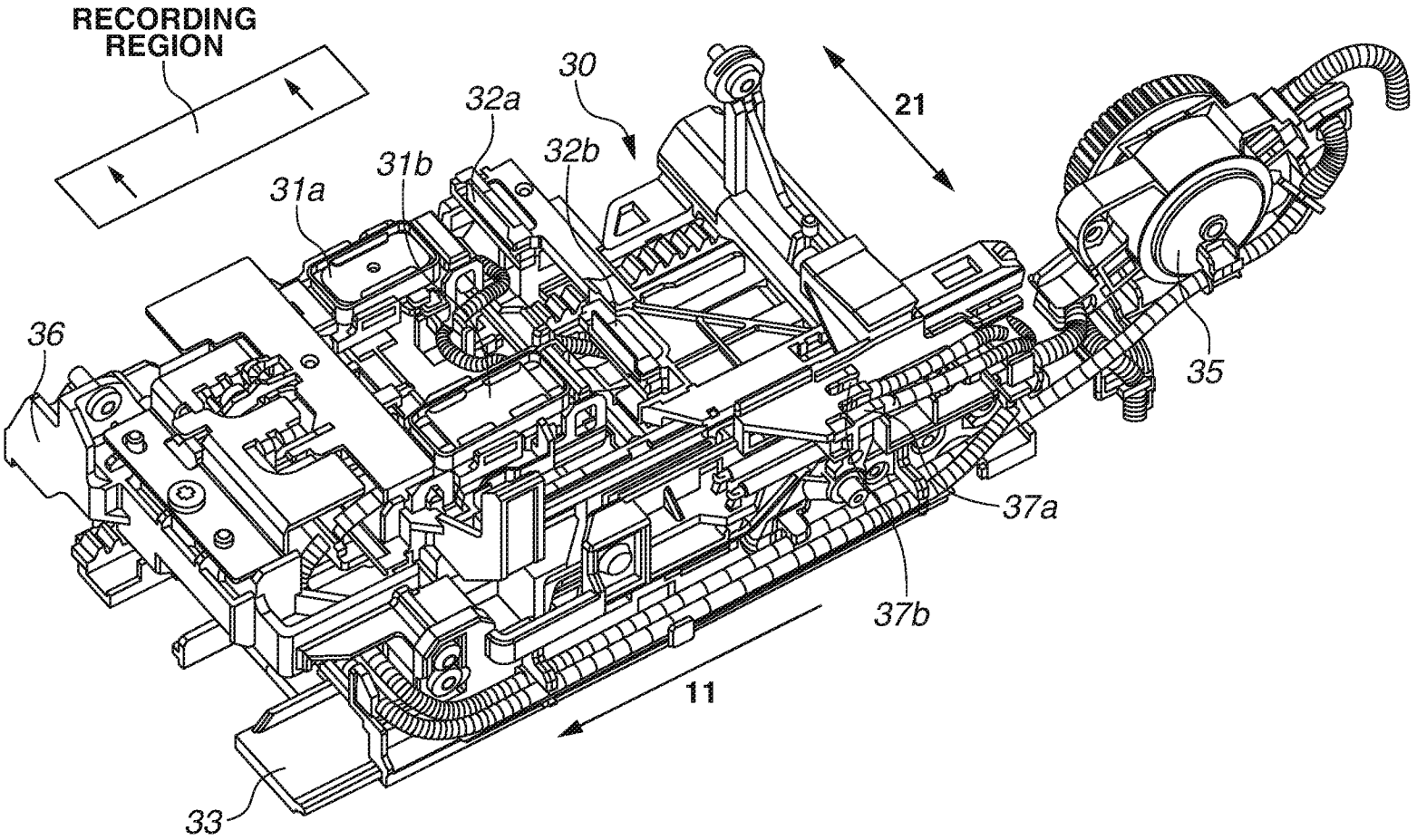
FIG. 3 is a perspective view illustrating a maintenance unit of the inkjet recording apparatus according to the first example embodiment.

The maintenance unit 30 is a mechanism that performs a recovery operation to maintain and recover the discharge performance of the recording head 2 and includes a cap 31 and a wiper 32 (refer to FIG. 3). The maintenance unit 30 is disposed outside a recording region, in which the recording operation is performed, and within a movement region, in which the carriage 20 is moved. The maintenance unit 30 is disposed at one of the ends in the main-scan direction 21, and the sheet conveyance unit 50 is disposed at the other end. In the present example embodiment, as illustrated in FIG. 1, the maintenance unit 30 is disposed on the right-hand side when viewed from the front of the recording apparatus 10, whereas the sheet conveyance unit 50 is disposed on the left-hand side when viewed from the front of the recording apparatus 10. Further, the maintenance unit 30 is driven by a driving source (not illustrated) of the sheet conveyance unit 50 via a driving train. Details of the maintenance unit 30 will be described below.

Figure 2:
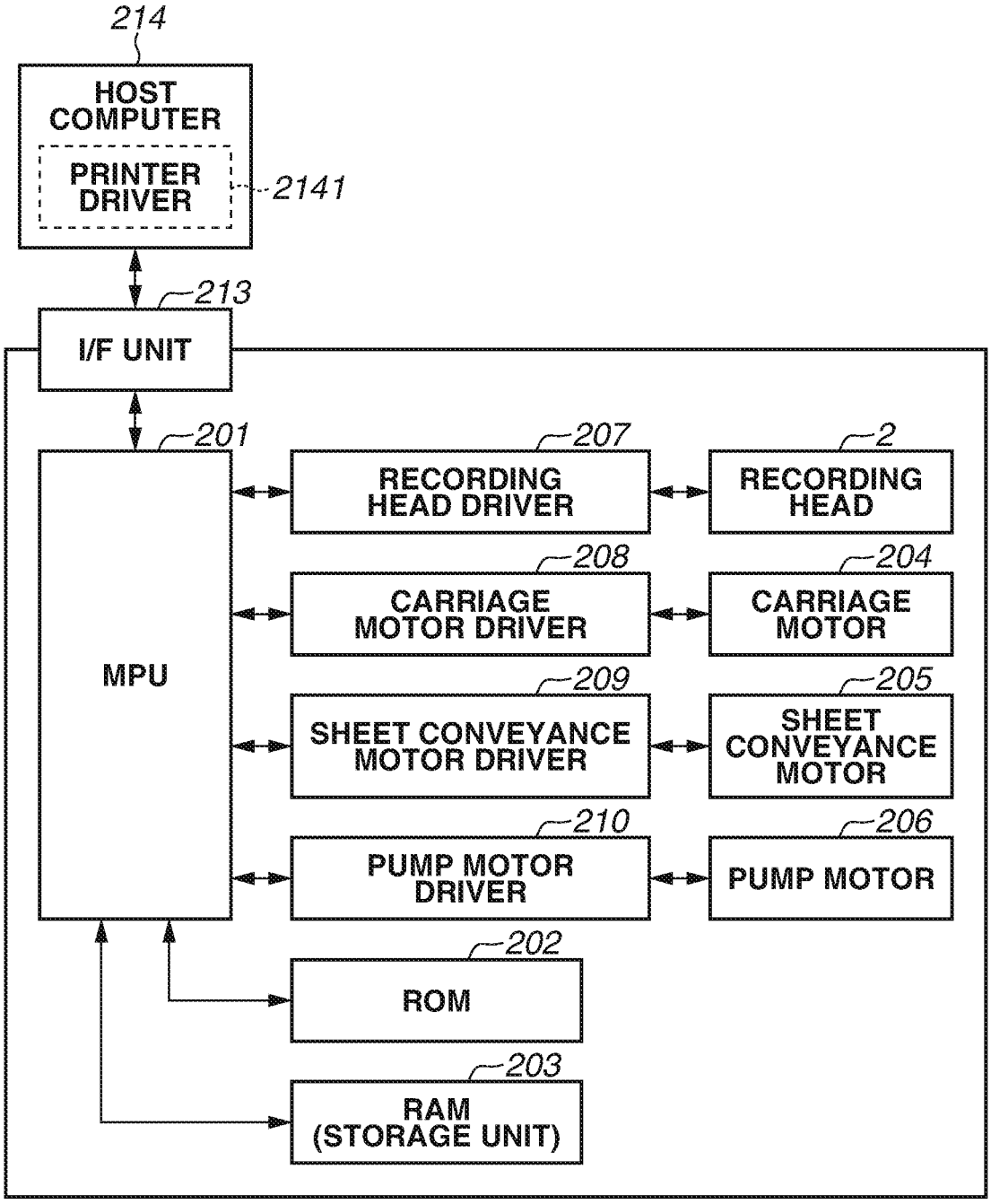
FIG. 2 is a block diagram illustrating a control unit configured to control the inkjet recording apparatus according to the first example embodiment.

FIG. 2 is a block diagram illustrating a control unit configured to control the recording apparatus 10. A microprocessing unit (MPU) 201 controls the entire recording apparatus 10 including the operations of respective units and data processing. A read-only memory (ROM) 202 stores various types of data and programs that are executed by the MPU 201. A random-access memory (RAM) 203 temporarily stores process data executed by the MPU 201 and data received from a host computer 214.

The recording head 2 is controlled by a recording head driver 207. A carriage motor 204 configured to drive the carriage 20 is driven by a carriage motor driver 208. A sheet conveyance roller of the sheet conveyance unit 50 is driven by a sheet conveyance motor 205. The sheet conveyance motor 205 is controlled by a sheet conveyance motor driver 209. A sheet feeding roller of the sheet feeding unit 40 and a pump 35 (refer to FIG. 3) of the maintenance unit 30, which will be described below, are driven by a pump motor 206. The pump motor 206 is controlled by a pump motor driver 210.

The host computer 214 is provided with a printer driver 2141 to communicate with the recording apparatus 10 to collectively exchange recording information, such as an image to be recorded and quality of the image to be recorded, when an instruction to execute a recording operation is given by a user. The MPU 201 exchanges images to be recorded, etc. with the host computer 214 via an interface (I/F) unit 213.

FIG. 3 is a perspective view illustrating the maintenance unit 30. The maintenance unit 30 includes the cap 31, the wiper 32, a cam slider (cam mechanism) 33, the pump 35, and an air valve lever 37. The cap 31 is made of an elastic member, such as a rubber, and covers the discharge opening surface 23 of the recording head 2 to seal (cap) the discharge opening surface 23 during the suction of the inks through the discharge openings of the recording head 2 (ink suction operation) and during a standby state of the recording apparatus 10. Further, the cap 31 receives the discharged inks during a preparatory discharge operation of discharging from the recording head 2 the inks that do not contribute to the recording operation.

The cap 31 is connected with the pump 35, and the pump 35 is driven by the pump motor 206 so that in a capping state, the inks are suctioned with a negative pressure to perform an ink suction operation. The discharge opening surface 23 of the recording head 2 includes a first discharge opening surface and a second discharge opening surface. The first discharge opening surface includes a discharge opening train for discharging color inks such as magenta, cyan, and yellow inks, and the second discharge opening surface includes a discharge opening train for discharging a black ink. The cap 31 includes a first cap 31*a* capable of capping the first discharge opening surface and a second cap 31*b* capable of capping the second discharge opening surface. The first cap 31*a* and the second cap 31*b* are connected with the pump 35 by a cap tube (not illustrated). The first cap 31*a* and the second cap 31*b* are sometimes collectively referred to as the cap 31.

The wiper 32 is blade-shaped and wipes (wiping operation) the inks remaining on the discharge opening surface 23 and the respective discharge opening trains after the ink suction operation. In the present example embodiment, the wiper 32 includes a first wiper 32*a*, which wipes the first discharge opening surface, and a second wiper 32*b*, which wipes the second discharge opening surface. The first wiper 32*a* and the second wiper 32*b* are sometimes collectively referred to as the wiper 32.

The air valve lever 37 is connected with the cap 31 to perform switching between the state in which the inside of the cap 31 is in communication with the atmospheric air and the state in which the inside of the cap 31 is not in communication with the atmospheric air. Specifically, when the air valve lever 37 is in contact with an air valve seal (not illustrated) made of a rubber, or the like, the inside of the cap 31 is not in communication with the atmospheric air, and when the air valve lever 37 is not in contact with the air valve seal, the inside of the cap 31 is in communication with the atmospheric air. The air valve lever 37 includes a first air valve lever 37*a* connected with the first cap 31*a* and a second air valve lever 37*b* connected with the second cap 31*b*. The first air valve lever 37*a* and the second air valve lever 37*b* can be driven independently of each other, so that, for example, the first cap 31*a* can singly be in communication with the atmospheric air. The cap 31 and the air valve lever 37 are connected by an air valve tube (not illustrated).

The cam slider 33 reciprocates in a direction that is the same as the sheet conveyance direction 11 by the same driving source as the sheet conveyance unit 50. When the cam slider 33 reciprocates, a cam surface of the cam slider 33 comes into contact with follower surfaces of the members in conjunction with the reciprocation, and the members of the maintenance unit 30 can operate independently. In the present example embodiment, the cam slider 33 reciprocates so that the cap 31, the wiper 32, and the air valve lever 37 operate independently. The pump 35 operates by the pump motor 206 different from that of the sheet conveyance unit 50.

The maintenance unit 30 only needs to include at least the cap 31 and the wiper 32. Specifically, the present example embodiment is not limited to the structure that uses all the members of the maintenance unit 30 described above.

Figure 4:
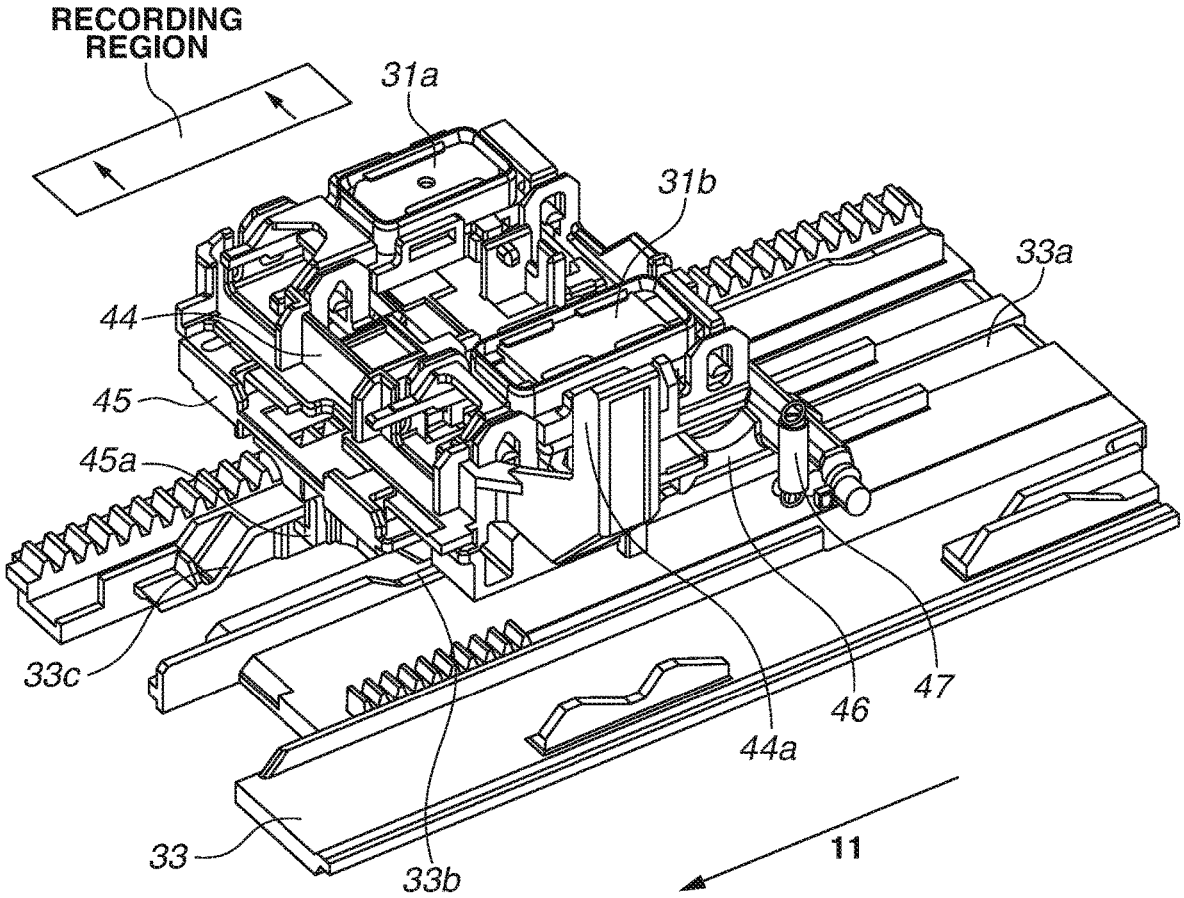
FIG. 4 is a perspective view selectively illustrating members that are involved in cap operations in the maintenance unit of the inkjet recording apparatus according to the first example embodiment.
Figure 5A:
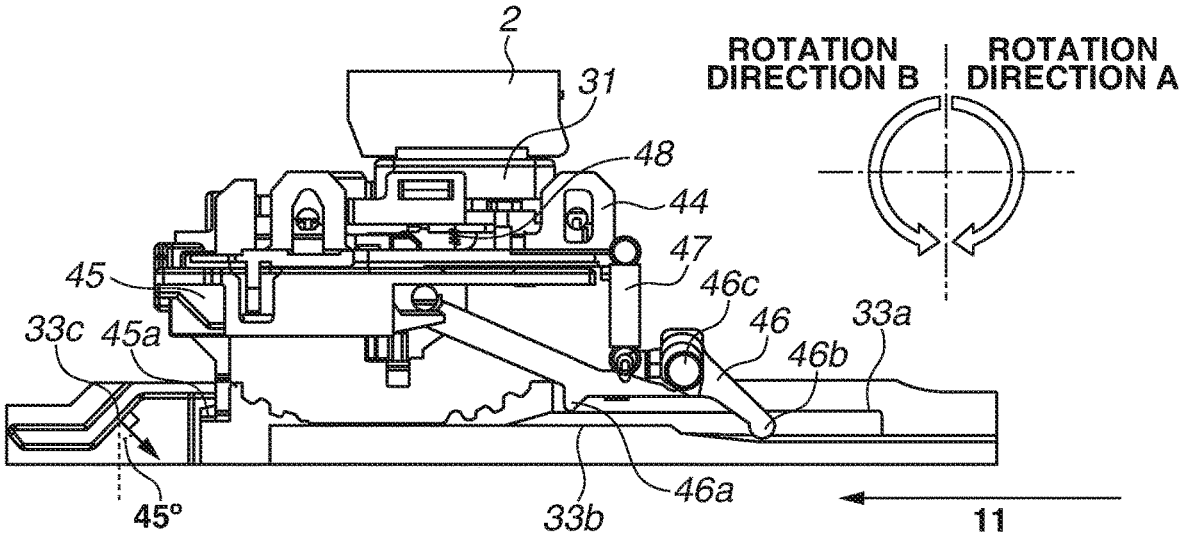
FIGS. 5A and 5B are side views illustrating operations of elevating/lowering a cap of the inkjet recording apparatus according to the first example embodiment.
Figure 5B:
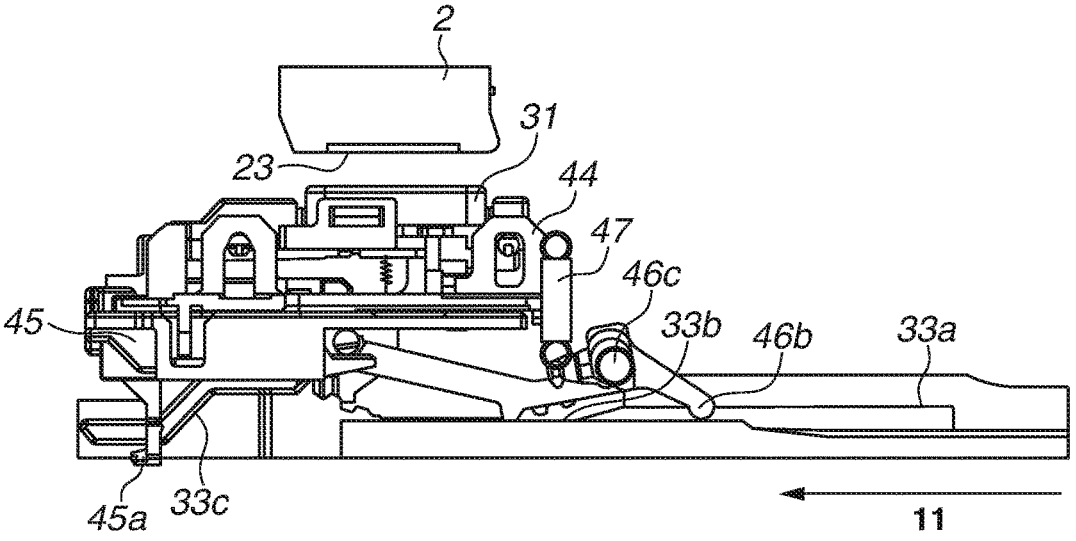

Next, the structure of the cap 31 and the operation of elevating/lowering the cap 31 with respect to the discharge opening surface 23 will be described below with reference to FIGS. 4, 5A, and 5B. FIG. 4 is a perspective view illustrating the members that are involved in the operation of elevating/lowering the cap 31 in the maintenance unit 30. FIGS. 5A and 5B are side views illustrating the operation of elevating/lowering the cap 31. Each of the side views illustrated in FIGS. 5A to 8 is a side view which is viewed from the right with respect to the front of the recording apparatus 10 in FIG. 1. In FIGS. 5A to 8, "rotation direction A" and "rotation direction B" are respectively defined as clockwise and anti-clockwise directions when the maintenance unit 30 is viewed from the opposite side (right-hand side when viewed from the front of the recording apparatus 10 in FIG. 1) to the recording region.

The cap 31 is attached to a cap slider 44 via a spring 48 as illustrated in FIGS. 5A and 5B. Four springs 48 are attached for one cap slider 44. The cap 31 is biased upward in the vertical direction, i.e., toward the discharge opening surface 23, by the springs 48. A buffer mechanism capable of moving microscopically in the vertical direction, such as the spring 48, is provided so that even if the recording head 2 enters in an unstable orientation, the discharge opening surface 23 and the cap 31 can be equalized to suitably face each other.

The cap slider 44 is attached to a cap base (holding member) 45 such that the cap slider 44 is slidable in the main-scan direction 21. The portion of the cap slider 44 that extends upward in the vertical direction includes a carriage contact portion 44*a* which is brought into contact with the carriage 20. The carriage contact portion 44*a* is brought into contact with the carriage 20 when the carriage 20 enters a recovery region, in which the maintenance unit 30 is disposed, from the recording region, whereby the discharge opening surface 23 and the cap 31 are positioned. Hereinafter, the cap 31, the cap slider 44, and the cap base 45 are sometimes collectively referred to as "cap unit".

Next, the operation of elevating/lowering the cap unit will be described below. The cap base 45 is supported so as to be capable of being elevated/lowered with respect to a PG base 36 (refer to FIG. 3) to thereby elevate/lower the cap 31 in the vertical direction. The PG base 36 also rotatably supports a cap arm (elevating/lowering member) 46, and the cap arm 46 is rotated about a rotation center 46*c* supported by the PG base 36. The rotation of the cap arm 46 elevates/lowers the cap 31, the cap slider 44, and the cap base 45.

As illustrated in FIGS. 5A and 5B, the cap arm 46 is also connected with an arm spring 47 in addition to the PG base 36 and is biased upward in the vertical direction by the arm spring 47. Specifically, the cap arm 46 is biased by the arm spring 47 to generate a moment in the direction of the contact with the discharge opening surface 23. The rotation of the cap arm 46 is conducted in response to the contact relationship between the follower surface of the cap arm 46 and the cam slider 33.

When the carriage 20 is moved to a recovery position to face the maintenance unit 30, the cam slider 33 is connected with a driving source to become reciprocable in the sheet conveyance direction 11. The contact relationship between the follower surface of the cap arm 46 and the cam surface of the cam slider 33 is switched by the reciprocation of the cam slider 33 in the sheet conveyance direction 11. Specifically, when the carriage 20 is in the recovery position, the cam slider 33 becomes reciprocable to enable the operation of elevating/lowering the cap 31 in the vertical direction.

FIG. 5A illustrates how the cap 31 caps the discharge opening surface 23, and the position of the cap unit at this time will be referred to as "capping position". The cam slider 33 includes a first cam surface 33*a* and a second cam surface 33*b*, and in FIGS. 5A and 5B, the first cam surface 33*a* is situated behind the second cam surface 33*b*. The cap arm 46 includes a first follower surface 46*a* on the downstream side in the sheet conveyance direction 11 and a second follower surface 46*b* on the upstream side in the sheet conveyance direction 11. When the cap unit is in the capping position, the first follower surface 46*a* of the cap arm 46 is in contact with the first cam surface 33*a* of the cam slider 33. The first follower surface 46*a* and the first cam surface 33*a* are in contact with each other so that the upward bias in the vertical direction by the arm spring 47 is stabilized and the position of the cap 31 in the vertical direction is determined. At this time, the second follower surface 46*b* of the cap arm 46 and the second cam surface 33*b* of the cam slider 33 are not in contact with each other.

FIG. 5B illustrates how the cap 31 is separated from the discharge opening surface 23, and the position of the cap unit at this time will be referred to as "retracted position". At this time, the second follower surface 46*b* of the cap arm 46 is in contact with the second cam surface 33*b* of the cam slider 33. Further, the first follower surface 46*a* and the first cam surface 33*a* are not in contact with each other. The second follower surface 46*b* and the second cam surface 33*b* are in contact with each other so that the right side (the second follower surface 46*b* side) of the cap arm 46 with respect to the rotation center 46*c* is biased upward in the vertical direction, whereas the left side (the first follower surface 46*a* side) of the cap arm 46 with respect to the rotation center 46*c* is biased downward in the vertical direction. Specifically, the second follower surface 46*b* and the second cam surface 33*b* are in contact with each other to generate a moment against the bias by the arm spring 47. Thus, the cap base 45 and the cap 31 which are connected with the left side of the cap arm 46 with respect to the rotation center 46*c* are biased downward in the vertical direction, and the cap 31 and the discharge opening surface 23 are not in contact with each other. The wiping by the wiper 32 is performed when the cap unit is in the retracted position.

The cam slider 33 is further provided with a third cam surface (auxiliary surface) 33*c*. The third cam surface 33*c* is a slope surface inclined with respect to the horizontal direction. In the present example embodiment, the third cam surface 33*c* is formed such that the normal line direction of the third cam surface 33*c* is adjusted to the direction rotated in the rotation direction B by about 45 [deg] from below in the vertical direction. Further, the cap base 45 includes a contact portion 45*a* provided downstream in the sheet conveyance direction 11 and extending downward in the vertical direction. The contact portion 45*a* is situated to interfere with the movement trace of the third cam surface 33*c* when the cam slider 33 is moved along the sheet conveyance direction 11. In the present example embodiment, the third cam surface 33*c* of the cam slider 33 and the contact portion 45*a* of the cap base 45 are brought into contact with each other to assist the separation of the cap 31 from the discharge opening surface 23 so that the operation of separating the cap 31 is facilitated. The inclination angle of the third cam surface 33*c* is not limited to 45 [deg] and can be set to any other numerical value.

Figures 6A, 6B, 6C, 6D:
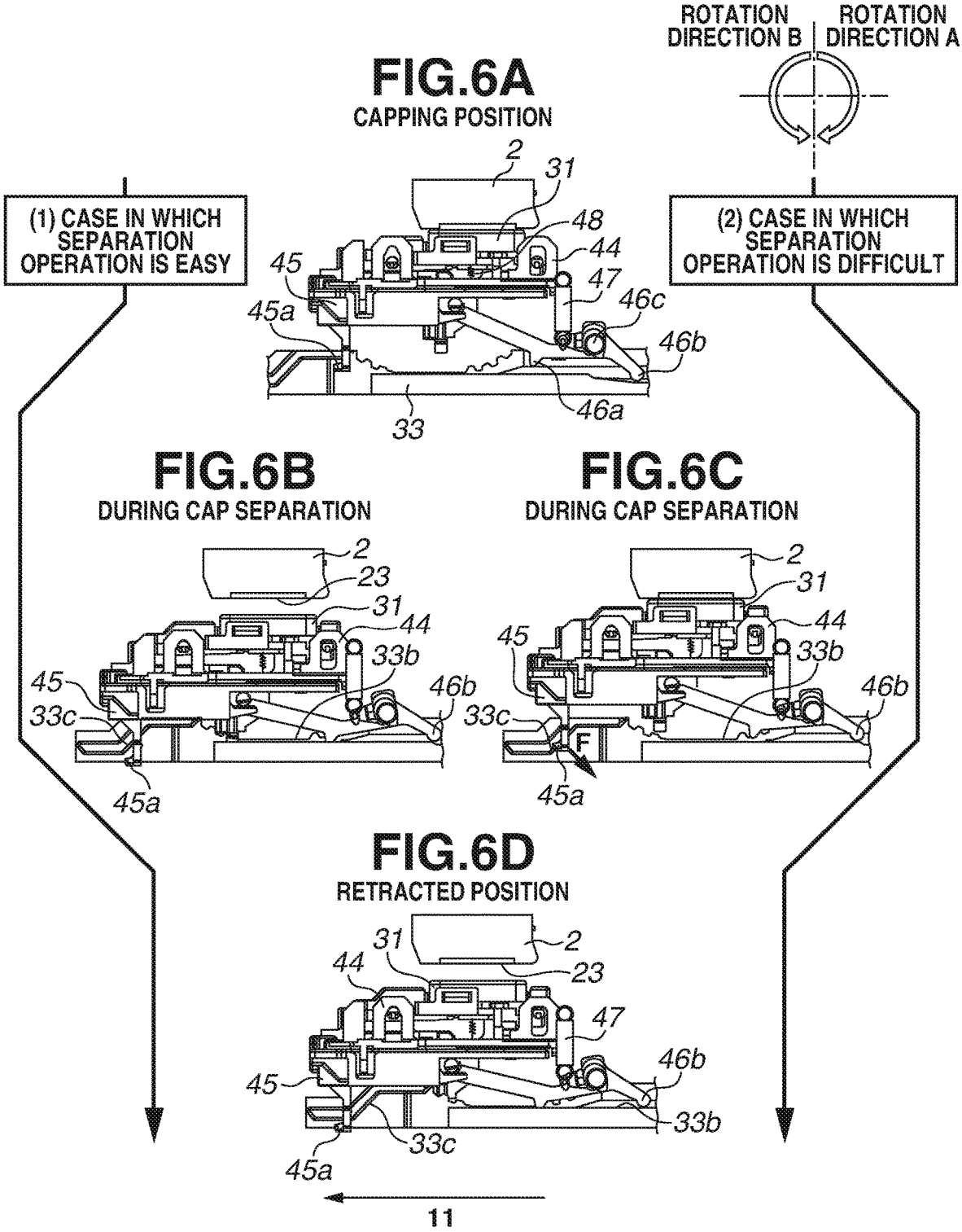
FIGS. 6A, 6B, 6C, and 6D are side views schematically illustrating a separation operation depending on the adhesion of the cap to a discharge opening surface in the inkjet recording apparatus according to the first example embodiment.

The operation of separating the cap 31 from the discharge opening surface 23 will be described below with reference to FIGS. 6A to 6D. Specifically, the separation operation in cases (1) and (2) will be described below. In the case (1), the cap 31 is separable by bringing the second follower surface 46*b* and the second cam surface 33*b* into contact with each other. In the case (2), the cap 31 is not separable by simply bringing the second follower surface 46*b* and the second cam surface 33*b* into contact with each other. Specifically, the case (1) is a case where the cap 31 does not adhere to the discharge opening surface 23 and the separation operation is easy, whereas the case (2) is a case where the cap 31 adheres to the discharge opening surface 23 and the separation operation is difficult. FIG. 6A illustrates the cap unit in the capping position. FIG. 6B illustrates the operation of separating the cap 31 in the case (1), and FIG. 6C illustrates the operation of separating the cap 31 in the case (2). FIG. 6D illustrates the cap unit in the retracted position.

First, the case (1) will be described below where the cap 31 does not adhere to the discharge opening surface 23, i.e., the separation operation is easy. This case corresponds to, for example, a case of capping with the discharge opening surface 23 and/or the cap 31 moistened by the ink or a case where the capping state is maintained for a relatively short time. In this case, by movement of the cam slider 33 downstream in the sheet conveyance direction 11, the second cam surface 33*b* and the second follower surface 46*b* are brought into contact with each other to generate a moment against the biasing force applied upward in the vertical direction by the arm spring 47. As illustrated in FIG. 6B, the cap arm 46 is rotated by the moment so that the separation operation is conducted to move the cap unit to the retracted position illustrated in FIG. 6D. The rotation of the cap arm 46 moves the cap unit downward to the retracted position so that while the cam slider 33 is moved, the third cam surface 33*c* and the contact portion 45*a* are not brought into contact with each other, and the separation operation is completed.

The following describes the case (2) where the cap 31 adheres to the discharge opening surface 23, i.e., the separation operation is difficult. This case corresponds to, for example, a case of capping with the discharge opening surface 23 and the cap 31 being in a dry state or a case where the capping state is maintained for a relatively long time. Especially, the discharge opening surface 23 is substantially an even surface, and if the cap 31 made of a rubber, or the like. is pressed against the discharge opening surface 23 being in the dry state, the cap 31 is tightly attached to adhere to the discharge opening surface 23. When the cap 31 adheres to the discharge opening surface 23 as described above, the moment generated as a result of bringing the second cam surface 33*b* and the second follower surface 46*b* into contact with each other can be insufficient to move the cap unit downward to the retracted position.

FIG. 6C illustrates the separation operation in the case where the cap 31 adheres to the discharge opening surface 23, illustrating how the cam slider 33 is moved downstream in the sheet conveyance direction 11 with the cap unit not being moved downward to the retracted position and the third cam surface 33*c* and the contact portion 45*a* are eventually brought into contact with each other. This occurs when the second cam surface 33*b* and the second follower surface 46*b* are brought into contact with each other to generate a moment to separate the cap 31 from the discharge opening surface 23 but the cap 31 strongly adheres to the discharge opening surface 23 to hinder the cap arm 46 from rotating. The third cam surface 33*c* and the contact portion 45*a* are brought into contact with each other so that a load F in the normal line direction of the third cam surface 33*c* is applied to a contact portion 45*c*. Specifically, the load F containing a shear direction component and a vertical component is applied to the cap 31 to assist the separation operation so that the separation of the cap 31 is facilitated.

As described above, the cam surface (the third cam surface 33*c*) that can be brought into contact only when the separation operation is difficult is provided separately from the cam surface (the second cam surface 33*b*) that is originally used in the separation operation, whereby the separation operation is facilitated. Further, the load F to press the cap unit downward is applied only when the cap 31 adheres to the discharge opening surface 23 and assistance is needed, whereas the load F to press the cap unit downward is not applied when assistance is not needed. This improves the durability of the contact portion 45*a* and the third cam surface 33*c*, compared with the structure in which a load is applied even when assistance is not needed in the separation operation. However, the present example embodiment can employ the structure in which the cap unit is pressed down even when assistance is not needed. Specifically, the cam slider 33 and the cap unit can be brought into contact with each other in addition to the bringing of the cam slider 33 and the elevating/lowering member of the cap 31 into contact with each other in the operation of separating the cap unit.

Figure 7:
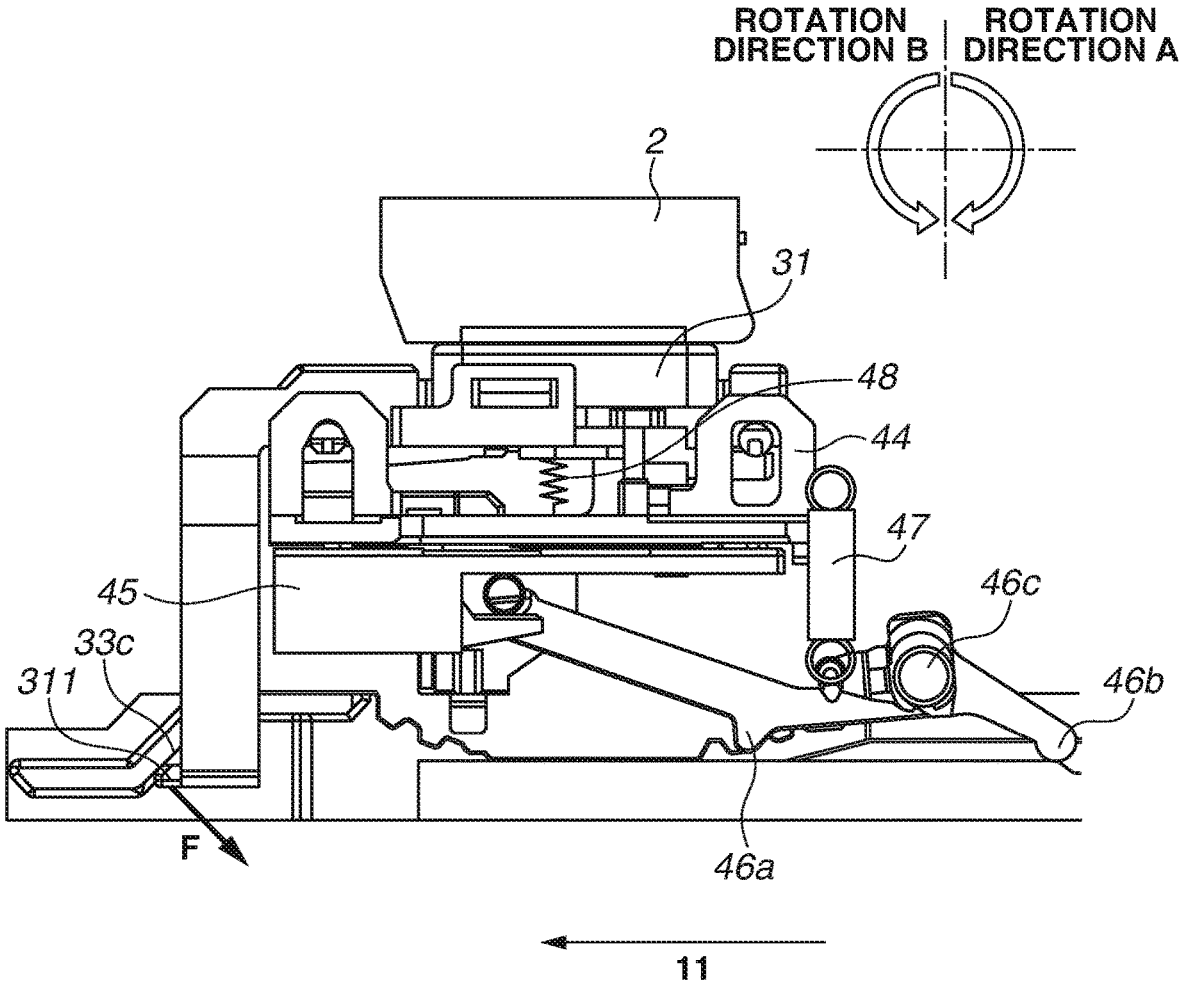
FIG. 7 is a side view illustrating an operation of separating the cap of the inkjet recording apparatus according to a second example embodiment.

A second example embodiment will be described below. In the first example embodiment, the example has been described in which the cam slider 33 is moved to bring the contact portion 45*a* of the cap base 45 into contact with the third cam surface 33*c* of the cam slider 33. The present example embodiment can employ a structure as illustrated in FIG. 7 in which a contact portion 311 of the cap 31 is brought into contact with the third cam surface 33*c* of the cam slider 33. Specifically, the cap 31 and the cap base 45 in the first example embodiment can be integrated.

FIG. 7 corresponds to FIG. 6C in the first example embodiment, and in the case where the cap 31 adheres to the discharge opening surface 23, the third cam surface 33*c* and the contact portion 311 of the cap 31 are brought into contact with each other, and the load F is directly applied to the cap 31. In this way, an advantage similar to that produced in the first example embodiment can be produced. Further, the cap 31 is structured to be capable of being equalized with respect to the discharge opening surface 23, and by bringing the contact portion 311 into contact with the third cam surface 33*c*, the cap 31 receives a rotation moment in the rotation direction B. Since the load F is directly applied to the cap 31, unlike the first example embodiment, the cap 31 is gradually separated from the discharge opening surface 23 by the rotation moment from the downstream side in the sheet conveyance direction 11.

A third example embodiment will be described below. In the first and second example embodiments, the cam slider 33 which reciprocates has been described as an example of the cam mechanism. The cam mechanism is not limited to the cam slider that reciprocates, and an example embodiment of the disclosure is also applicable to a cam mechanism that rotates as illustrated in FIGS. 8A to 8D. Examples include a cam mechanism in which a rotary cam 83 capable of rotating, a link cam 84, and a slide cam 85 are attached to the PG base 36.

The rotary cam 83 includes a first cam surface 83*b* and a second cam surface 83*c*. The link cam 84 is a long and thin rod-shaped cam and includes a first contact portion 84*a* at one of the ends and a second contact portion 84*b* at the other end. The first contact portion 84*a* can be brought into contact with the second cam surface 83*c* of the rotary cam 83. The second contact portion 84*b* is biased toward the rotation direction B by a spring. The slide cam 85 can reciprocate rightward and leftward in FIGS. 8A to 8D and is biased leftward in FIGS. 8A to 8D by a spring. The slide cam 85 includes a first contact surface 85*a* and a second contact surface 85*b*. The first contact surface 85*a* can be brought into contact with the second contact portion 84*b* of the link cam 84. The second contact surface 85*b* can be brought into contact with the contact portion 45*a* of the cap base 45. The second contact surface 85*b* is a slope surface inclined in a direction similar to the direction in which the third cam surface 33*c* in the first example embodiment is inclined. The contact portion 45*a* of the cap base 45 is shaped to protrude leftward in FIGS. 8A to 8D, unlike the first example embodiment.

Figures 8A, 8B, 8C, 8D:
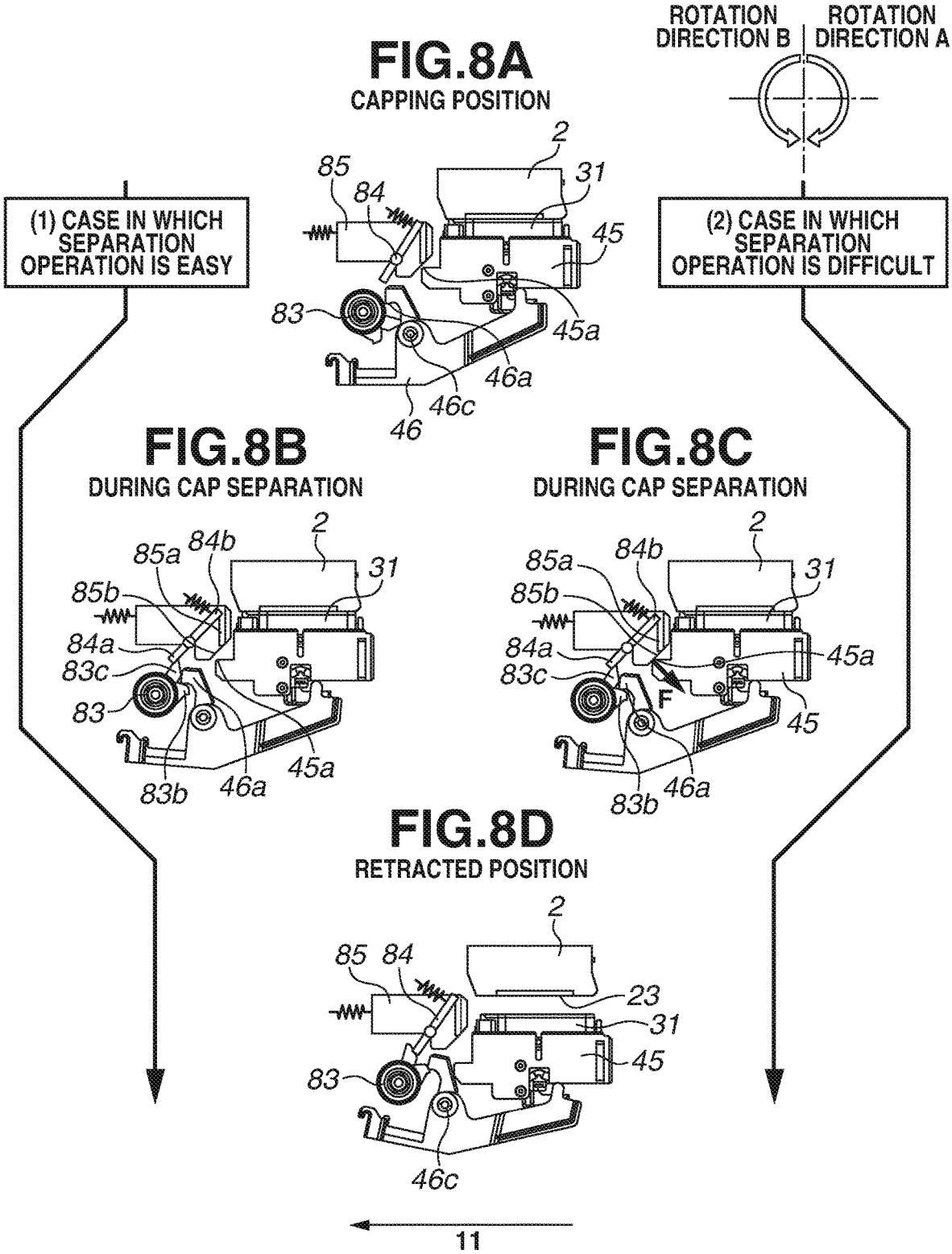
FIGS. 8A, 8B, 8C, and 8D are side views schematically illustrating a separation operation depending on the adhesion of the cap to a discharge opening surface in the inkjet recording apparatus according to a third example embodiment.

The operation in the case (1) where the cap 31 does not adhere to the discharge opening surface 23 and the operation in the case (2) where the cap 31 adheres to the discharge opening surface 23 will be described below, as in the first example embodiment, with reference to FIGS. 8A to 8D. FIG. 8A illustrates the cap unit is in the capping position. FIG. 8B illustrates the operation of separating the cap 31 in the case (1), and FIG. 8C illustrates the operation of separating the cap 31 in the case (2). FIG. 8D illustrates the cap unit in the retracted position.

First, the case (1) will be described below where the cap 31 does not adhere to the discharge opening surface 23 and the separation operation is easy. When the rotary cam 83 is rotated anti-clockwise, the first cam surface 83*b* of the rotary cam 83 is brought into contact with the first follower surface 46*a* of the cap arm 46 so that the cap arm 46 is rotated about the rotation center 46*c* in the rotation direction A. Consequently, the right side with respect to the rotation center 46*c* which is connected with the cap base 45 is pressed downward in the vertical direction. In this way, the cap unit is pressed downward in the vertical direction and moved to the retracted position illustrated in FIG. 8D.

At this time, the second cam surface 83*c* of the rotary cam 83 and the first contact portion 84*a* of the link cam 84 are also brought into contact with each other. This contact causes the link cam 84 to rotate in the rotation direction A so that the second contact portion 84*b* is biased in the direction against the bias of the spring to come into contact with the first contact surface 85*a* of the slide cam 85. In this way, the slide cam 85 is slid rightward in FIGS. 8A to 8D. In the case (1), the first cam surface 83*b* and the first follower surface 46*a* are brought into contact with each other to lower the cap unit, so that the slide cam 85 is not in contact with the cap base 45.

Next, the case (2) will be described below where the cap 31 adheres to the discharge opening surface 23 and the separation operation is difficult. In this case, the bringing of the first cam surface 83*b* and the first follower surface 46*a* into contact with each other can be insufficient to lower the cap unit to the retracted position. FIG. 8C illustrates the separation operation in the case where the cap 31 adheres to the discharge opening surface 23, and as in the case (1), when the slide cam 85 is slid rightward, the second contact surface 85*b* of the slide cam 85 and the contact portion 45*a* of the cap base 45 are brought into contact with each other. As a result of the contact, the load F in the normal line direction of the second contact surface 85*b* is applied to the cap base 45 to assist the separation operation. Specifically, the cam mechanism that rotates also produces an advantage similar to that produced in the first example embodiment.

Specifically, according to an example embodiment of the disclosure, an inkjet recording apparatus capable of separating a cap from a discharge opening surface with ease is provided.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2017-146728, filed Jul. 28, 2017, which is hereby incorporated by reference herein in its entirety.

What is claimed is:

1. An inkjet recording apparatus comprising:

a recording head including a discharge opening surface in which a discharge opening configured to discharge ink is arranged;

a cap unit capable of being moved to a capping position to cover the discharge opening surface and to a separate position separated from the discharge opening surface;

a cap moving member configured to move the cap unit between the capping position and the separate position;

a cam mechanism including a first cam portion and a second cam portion;

a first separation mechanism configured to bring the first cam portion and the cap moving member into contact with each other and apply a force in a first direction in which the cap unit is moved to the separate position, and a second separation mechanism configured to bring the second cam portion and the cap unit into contact with each other and apply a force in the first direction and in a second direction intersecting with the first direction.

2. The inkjet recording apparatus according to claim 1, wherein in a case where the cap unit is moved to the separate position by the first separation mechanism, the second separation mechanism does not bring the second cam portion and the cap unit into contact with each other, and in a case where the cap unit is not moved to the separate position by the first separation mechanism, the second separation mechanism brings the second cam portion and the cap unit contact with each other.

3. The inkjet recording apparatus according to claim 1, wherein the cap unit includes a cap configured to cover the discharge opening surface and a holding member configured to hold the cap, and the second separation mechanism brings the second cam portion and a contact portion of the holding member into contact with each other.

4. The inkjet recording apparatus according to claim 1, wherein the cam mechanism includes a cam slider which is driven by a driving unit to be capable of reciprocating, and the first separation mechanism brings the cam slider and the cap moving member into contact with each other by the reciprocation of the cam slider.

5. The inkjet recording apparatus according to claim 4, wherein the recording head is mounted on a carriage configured to reciprocate in a third direction, and the cam slider reciprocates in a fourth direction intersecting with the third direction.

6. The inkjet recording apparatus according to claim 5, wherein the first direction corresponds to a direction of gravity and the second direction corresponds to the fourth direction.

7. The inkjet recording apparatus according to claim 1, wherein the cam mechanism includes a third cam portion which can be brought into contact with the cap moving member, and wherein the cap moving member is brought into contact with the third cam portion to move the cap unit to the capping position.

8. The inkjet recording apparatus according to claim 1, wherein the cam mechanism includes a rotary cam which is driven by a driving unit, and wherein the first separation mechanism brings the rotary cam and the cap moving member into contact with each other by the rotation of the rotary cam.

9. The inkjet recording apparatus according to claim 8, further comprising a slide cam configured to be slid by the rotation of the rotary cam, and the second cam portion is provided on the slide cam.

10. The inkjet recording apparatus according to claim 1, wherein the cap moving member is driven to rotate by the cam mechanism.

11. The inkjet recording apparatus according to claim 1, wherein the second direction corresponds to a shear direction of the cap unit.

12. The inkjet recording apparatus according to claim 1, wherein the cap moving member is biased in a direction in which the cap unit is moved to the capping position.

* * * * *